US007414598B2

(12) United States Patent
Lee

(10) Patent No.: US 7,414,598 B2
(45) Date of Patent: Aug. 19, 2008

(54) APPARATUS AND METHOD FOR DRIVING PLASMA DISPLAY PANEL

(75) Inventor: Kan Han Lee, Daegu (KR)

(73) Assignee: LG Electronics Inc., Seoul (KR)

( * ) Notice: Subject to any disclaimer, the term of this patent is extended or adjusted under 35 U.S.C. 154(b) by 615 days.

(21) Appl. No.: 11/000,519

(22) Filed: Dec. 1, 2004

(65) Prior Publication Data

US 2005/0162352 A1 Jul. 28, 2005

(30) Foreign Application Priority Data

Dec. 1, 2003 (KR) ..... 10-2003-0086380

(51) Int. Cl.
*G09G 3/28* (2006.01)
*G09G 5/10* (2006.01)

(52) U.S. Cl. ..... 345/63; 345/600; 345/690; 315/169.1; 315/169.4; 358/519; 358/521

(58) Field of Classification Search ..... 345/60–68, 345/596–602, 690, 589–591, 597; 315/169.1–169.4; 348/254, 558, 563; 358/519, 521
See application file for complete search history.

(56) References Cited

U.S. PATENT DOCUMENTS 6,476,824 B1 * 11/2002 Suzuki et al. ..... 345/690
6,965,358 B1 * 11/2005 Kasahara et al. ..... 345/63
6,965,389 B1 * 11/2005 Masuji et al. ..... 345/690
7,071,902 B1 * 7/2006 Kawahara ..... 345/63
7,102,696 B2 9/2006 Kao et al.
7,126,563 B2 * 10/2006 Lin et al. ..... 345/63
2002/0176024 A1 11/2002 Kao et al.

FOREIGN PATENT DOCUMENTS

| | | |
|---|---|---|
| EP | 1 083 539 A2 | 3/2001 |
| EP | 1 538 592 | 6/2005 |
| JP | 2001-75521 | 3/2001 |
| JP | 2001-092407 | 4/2001 |
| TW | 508560 | 1/2002 |

* cited by examiner

*Primary Examiner*—Henry N Tran
(74) *Attorney, Agent, or Firm*—McKenna Long & Aldridge LLP

(57) ABSTRACT

Disclosed herein are an apparatus for driving a plasma display panel in which the capability to represent the gray scale can be improved, and method thereof. The apparatus includes an inverse gamma control block for performing an inverse gamma correction process on input data received from the outside by using two or more gamma values, and a select unit for outputting one of two or more output data on which the inverse gamma correction operation is performed, which is outputted from the inverse gamma control block. Therefore, the capability to represent the gray scale can be improved. Furthermore, an error diffusion pattern and pseudo noise can be reduced and the picture quality can be thus improved.

34 Claims, 7 Drawing Sheets

Fig. 5

| First inverse gamma control block | | Second inverse gamma control block | | Third inverse gamma control block | | Fourth inverse gamma control block | |
|---|---|---|---|---|---|---|---|
| Input gray scale value | Output value | Input gray scale value | Output value | Input gray scale value | Output value | Input gray scale value | Output value |
| 0 | 0 | 0 | 0.1 | 1 | 0.01 | 1 | 0.2 |
| 1 | 0 | 1 | 0.1 | 2 | 0.01 | 2 | 0.2 |
| 2 | 0 | 2 | 0.1 | 3 | 0.01 | 3 | 0.2 |
| 3 | 0 | 3 | 0.1 | 4 | 0.01 | 4 | 0.2 |
| 4 | 0 | 4 | 0.1 | 5 | 0.01 | 5 | 0.2 |
| 5 | 0 | 5 | 0.1 | 6 | 0.01 | 6 | 0.2 |
| 6 | 0.0625 | 6 | 0.1625 | 7 | 0.0725 | 7 | 0.2625 |
| 7 | 0.0625 | 7 | 0.1625 | 8 | 0.0725 | 8 | 0.2625 |
| 8 | 0.125 | 8 | 0.225 | 9 | 0.135 | 9 | 0.325 |
| 9 | 0.125 | 9 | 0.225 | 10 | 0.135 | 10 | 0.325 |
| 10 | 0.1875 | 10 | 0.2875 | 11 | 0.1975 | 11 | 0.3875 |
| 11 | 0.25 | 11 | 0.35 | 12 | 0.26 | 12 | 0.45 |
| 12 | 0.25 | 12 | 0.35 | 13 | 0.26 | 13 | 0.45 |
| 13 | 0.3125 | 13 | 0.4125 | 14 | 0.3225 | 14 | 0.5125 |
| 14 | 0.375 | 14 | 0.475 | 15 | 0.385 | 15 | 0.575 |
| 15 | 0.5 | 15 | 0.6 | 16 | 0.51 | 16 | 0.7 |
| 16 | 0.5625 | 16 | 0.6625 | 17 | 0.5725 | 17 | 0.7625 |
| ⋮ | ⋮ | ⋮ | ⋮ | ⋮ | ⋮ | ⋮ | ⋮ |
| 240 | 223.125 | 240 | 223.225 | 241 | 223.135 | 241 | 223.325 |
| 241 | 225.1875 | 241 | 225.2875 | 242 | 225.1975 | 242 | 225.3875 |
| 242 | 227.25 | 242 | 227.35 | 243 | 227.26 | 243 | 227.45 |
| 243 | 229.3125 | 243 | 229.4125 | 244 | 229.3225 | 244 | 229.5125 |
| 244 | 231.375 | 244 | 231.475 | 245 | 231.385 | 245 | 231.575 |
| 245 | 233.5 | 245 | 233.6 | 246 | 233.51 | 246 | 233.7 |
| ⋮ | ⋮ | ⋮ | ⋮ | ⋮ | ⋮ | ⋮ | ⋮ |

Fig. 6

| First inverse gamma control block | | Second inverse gamma control block | | Third inverse gamma control block | | Fourth inverse gamma control block | |
|---|---|---|---|---|---|---|---|
| Input gray scale value | Output value | Input gray scale value | Output value | Input gray scale value | Output value | Input gray scale value | Output value |
| 0 | 0 | 0 | 0 | 1 | 0.0625 | 1 | 0 |
| 1 | 0 | 1 | 0 | 2 | 0.0625 | 2 | 0 |
| 2 | 0 | 2 | 0 | 3 | 0.125 | 3 | 0.0625 |
| 3 | 0 | 3 | 0.0625 | 4 | 0.125 | 4 | 0.0625 |
| 4 | 0 | 4 | 0.0625 | 5 | 0.1875 | 5 | 0.125 |
| 5 | 0 | 5 | 0.125 | 6 | 0.25 | 6 | 0.125 |
| 6 | 0.0625 | 6 | 0.125 | 7 | 0.25 | 7 | 0.1875 |
| 7 | 0.0625 | 7 | 0.1875 | 8 | 0.3125 | 8 | 0.25 |
| 8 | 0.125 | 8 | 0.25 | 9 | 0.375 | 9 | 0.25 |
| 9 | 0.125 | 9 | 0.25 | 10 | 0.5 | 10 | 0.3125 |
| 10 | 0.1875 | 10 | 0.3125 | 11 | 0.5625 | 11 | 0.375 |
| 11 | 0.25 | 11 | 0.375 | 12 | 0.625 | 12 | 0.5 |
| 12 | 0.25 | 12 | 0.5 | 13 | 0.75 | 13 | 0.5625 |
| 13 | 0.3125 | 13 | 0.5625 | 14 | 0.8125 | 14 | 0.625 |
| 14 | 0.375 | 14 | 0.625 | 15 | 0.9375 | 15 | 0.75 |
| 15 | 0.5 | 15 | 0.75 | 16 | ⋮ | 16 | 0.8125 |
| 16 | 0.5625 | 16 | 0.8125 | 17 | | 17 | 0.9375 |
| ⋮ | ⋮ | ⋮ | ⋮ | ⋮ | | ⋮ | ⋮ |
| 240 | 223.125 | 240 | 229.3125 | 241 | 241.9375 | 241 | 231.375 |
| 241 | 225.1875 | 241 | 231.375 | 242 | 244.125 | 242 | 233.5 |
| 242 | 227.25 | 242 | 233.5 | 243 | 246.25 | 243 | 235.5625 |
| 243 | 229.3125 | 243 | 235.5625 | 244 | 248.4375 | 244 | 237.6875 |
| 244 | 231.375 | 244 | 237.6875 | 245 | 250.5625 | 245 | 239.8125 |
| 245 | 233.5 | 245 | 239.8125 | 246 | 252.75 | 246 | 241.9375 |
| ⋮ | ⋮ | ⋮ | ⋮ | ⋮ | ⋮ | ⋮ | ⋮ |

Fig. 7

| First inverse gamma control block | | Second inverse gamma control block | | Third inverse gamma control block | | Fourth inverse gamma control block | |
|---|---|---|---|---|---|---|---|
| Input gray scale value | Output value | Input gray scale value | Output value | Input gray scale value | Output value | Input gray scale value | Output value |
| 0 | 0 | 0 | 0.1 | 0 | 0.01 | 0 | 0.2 |
| 1 | 0 | 1 | 0.1 | 1 | 0.01 | 1 | 0.2 |
| 2 | 0 | 2 | 0.1 | 2 | 0.01 | 2 | 0.2 |
| 3 | 0 | 3 | 0.1 | 3 | 0.01 | 3 | 0.2 |
| 4 | 0 | 4 | 0.1 | 4 | 0.01 | 4 | 0.2 |
| 5 | 0 | 5 | 0.1 | 5 | 0.01 | 5 | 0.2 |
| 6 | 0.0625 | 6 | 0.1625 | 6 | 0.0725 | 6 | 0.2625 |
| 7 | 0.0625 | 7 | 0.1625 | 7 | 0.0725 | 7 | 0.2625 |
| 8 | 0.125 | 8 | 0.225 | 8 | 0.135 | 8 | 0.325 |
| 9 | 0.125 | 9 | 0.225 | 9 | 0.135 | 9 | 0.325 |
| 10 | 0.1875 | 10 | 0.2875 | 10 | 0.1975 | 10 | 0.3875 |
| 11 | 0.25 | 11 | 0.35 | 11 | 0.26 | 11 | 0.45 |
| 12 | 0.25 | 12 | 0.35 | 12 | 0.26 | 12 | 0.45 |
| 13 | 0.3125 | 13 | 0.4125 | 13 | 0.3225 | 13 | 0.5125 |
| 14 | 0.375 | 14 | 0.475 | 14 | 0.385 | 14 | 0.575 |
| 15 | 0.5 | 15 | 0.6 | 15 | 0.51 | 15 | 0.7 |
| 16 | 0.5625 | 16 | 0.6625 | 16 | 0.5725 | 16 | 0.7625 |
| ⋮ | ⋮ | ⋮ | ⋮ | ⋮ | ⋮ | ⋮ | ⋮ |
| 240 | 223.125 | 240 | 223.125 | 240 | 223.125 | 240 | 223.125 |
| 241 | 225.1875 | 241 | 225.1875 | 241 | 225.1875 | 241 | 225.1875 |
| 242 | 227.25 | 242 | 227.25 | 242 | 227.25 | 242 | 227.25 |
| 243 | 229.3125 | 243 | 229.3125 | 243 | 229.3125 | 243 | 229.3125 |
| 244 | 231.375 | 244 | 231.375 | 244 | 231.375 | 244 | 231.375 |
| 245 | 233.5 | 245 | 233.5 | 245 | 233.5 | 245 | 233.5 |
| ⋮ | ⋮ | ⋮ | ⋮ | ⋮ | ⋮ | ⋮ | ⋮ |

APPARATUS AND METHOD FOR DRIVING PLASMA DISPLAY PANEL

This Nonprovisional application claims priority under 35 U.S.C. § 119(a) on Patent Application No. 10-2003-0086380 filed in Korea on Dec. 1, 2003, the entire contents of which are hereby incorporated by reference.

BACKGROUND OF THE INVENTION

1. Field of the Invention

The present invention relates to an apparatus and method for driving a plasma display panel, and more particularly, to an apparatus and method for driving a plasma display panel in which the capability to represent the gray scale can be improved.

2. Description of the Background Art

A plasma display panel (hereinafter, referred to as a 'PDP') is adapted to display an image by using a visible ray generated from phosphors when ultraviolet rays generated by the discharge of a gas excite the phosphors. This PDP is advantageous it that it can provide the slimness, the compact size, higher definition and large screen, compared to the cathode ray tube (CRT).

FIG. 1 is a schematic plan view showing a conventional three-electrode AC surface discharge type PDP. FIG. 2 is a detailed perspective view illustrating the construction of the cell shown in FIG. 1.

Referring to FIGS. 1 and 2, the PDP includes scan electrodes Y1 to Yn and sustain electrodes Z which are formed on the bottom surface of an upper substrate 10, and address electrodes X1 to Xm formed on a lower substrate 18.

Discharge cells 1 of the PDP are formed every crossing of the scan electrodes Y1 to Yn, the sustain electrodes Z and the address electrodes X1 to Xm.

Each of the scan electrodes Y1 to Yn and the sustain electrodes Z includes a transparent electrode 12, and a metal bus electrode 11 that has a line width smaller than that of the transparent electrode 12 and is disposed at one edge side of the transparent electrode. The transparent electrode 12, which is generally made of ITO (indium tin oxide), is formed on the bottom surface of the upper substrate 10. The metal bus electrode, which is typically made of metal, is formed on the transparent electrode 12 and serves to reduce a voltage drop caused by the transparent electrode 12 having high resistance. On the bottom surface of the upper substrate 10 in which the scan electrodes Y1 to Yn and the sustain electrodes Z are disposed is laminated an upper dielectric layer 13 and a protective layer 14. The upper dielectric layer 13 is accumulated with wall charges generated during plasma discharging. The protective layer 14 is adapted to prevent damages of the electrodes Y1 to Yn, Z and the upper dielectric layer 13 due to sputtering caused during the plasma discharging, and improve efficiency of secondary electron emission. Magnesium oxide (MgO) is generally used as the protective layer 14.

The address electrodes X1 to Xm are formed in the lower substrate 18 in the direction in which they intersect the scan electrodes Y1 to Yn and the sustain electrodes Z. A lower dielectric layer 17 and barrier ribs 15 are formed on the lower substrate 18. The barrier ribs 24 are formed in a stripe or grating shape to separate the discharge cells 1, thus prohibiting electrical and optical interference among neighboring discharge cells 1. The phosphor layer 16 is excited with ultraviolet rays generated during the plasma discharging to generate a visible light of any one of red, green and blue lights.

An inert mixed gas such as He+Xe, Ne+Xe or He+Ne+Xe is injected into the discharge spaces of the discharge cells defined between the upper substrate 10 and the barrier ribs 15 and between the lower substrate 18 and the barrier ribs 15.

This PDP is driven with one frame being time-divided into a plurality of sub-fields having a different number of emission in order to implement the gray scale of an image. Each of the sub fields is divided into a reset period for uniformly generating discharging, an address period for selecting a discharge cell, and a sustain period for implementing the gray level according to the number of discharging. For example, if it is desired to display an image with 256 gray scales, a frame period (16.67 ms) corresponding to 1/60 seconds is divided into eight sub-fields SF1 to SF8. Each of the eight sub-fields SF1 to SF8 is subdivided into the reset period, the address period and the sustain period. The reset period and the address period of each of the sub-fields SF1 to SF8 are the same every sub-field, whereas the sustain period and the number of discharging increase in the ratio of $2^n$ (where, n=0, 1, 2, 3, 4, 5, 6, 7) in each sub-field. Since the sustain period becomes different in each sub-field as such, the gray scale of an image can be implemented.

FIG. 3 is a block diagram showing an apparatus for driving a PDP in the prior art.

Referring to FIG. 3, the conventional apparatus for driving the PDP includes a gain adjustment unit 32, an error diffusion unit 33 and a sub-field mapping unit 34 all of which are connected between an inverse gamma control unit 31 and a data alignment unit 35, and an average picture level (APL) calculation unit 36 connected between the inverse gamma control unit 31 and a waveform generator 37.

The inverse gamma correction unit 31 linearly converts digital video data RGB of an input line 30 into the brightness for a gray scale value of a picture signal by using a 2.2 gamma table.

The gain adjustment unit 32 compensates for color temperature by adjusting an effective gain every data of R (red), G (green) and B (blue).

The error diffusion unit 33 finely adjusts the gray scale value by diffusing a quantization error of the digital video data RGB received from the gain adjustment unit 32 to neighboring cells.

The sub-field mapping unit 34 maps the data received from the error diffusion unit 33 to sub-field patterns which are previously stored therein on a per bit basis, and supplies the mapped data to the data alignment unit 35.

The data alignment unit 35 supplies the digital video data received from the sub-field mapping unit 34 to a data driving circuit of a panel 38. The data driving circuit is connected to address electrodes of the panel 38. It latches the data received from the data alignment unit 35 by 1 horizontal line and supplies the latched data to the address electrodes of the panel 38 in a 1 horizontal unit.

The APL calculation unit 36 calculates an APL in one screen unit for the digital video data RGB received from the inverse gamma correction unit 31, and outputs information on the number of a sustain pulse corresponding to the calculated APL.

The waveform generator 37 generates a timing control signal in response to the information on the number of the sustain pulse outputted from the APL calculation unit 36, and supplies the timing control signal to a scan driving circuit (not shown) and a sustain driving circuit (not shown). The scan driving circuit and the sustain driving circuit supplies the sustain pulse to scan electrodes and sustain electrodes of the panel 38 during a sustain period in response to the timing control signal from the waveform generator 37.

The conventional PDP has a limit to the capability to represent the gray scale because the gray scales are represented using sub-fields included in one frame. If the gray scales are represented using only the sub-fields, however, pseudo noise is generated in the panel 38. Therefore, in the conventional PDP, in order to improve the capability to represent the gray scale, the error diffusion unit 33 is employed. The error diffusion unit 33 calculates quantization error data of data, differentiates the calculated error data every weight, and diffuses the differentiated error data to neighboring pixels, thus expanding the gray scale. In this error diffusion method, however, error diffusion coefficients (i.e., weight) for neighboring pixels are set to be constant. Accordingly, there is a problem in that an error diffusion pattern is generated as the error diffusion coefficients are repeated every line and every frame.

SUMMARY OF THE INVENTION

Accordingly, an object of the present invention is to solve at least the problems and disadvantages of the background art.

It is an object of the present invention to provide an apparatus and method for driving a plasma display panel in which the capability to represent the gray scale can be improved.

To achieve the above object, according to the present invention, there is provided an apparatus for driving a plasma display panel, including: an inverse gamma control block for performing an inverse gamma correction process on input data received from the outside by using two or more gamma values, and a select unit for outputting one of two or more output data on which the inverse gamma correction operation is performed, which is outputted from the inverse gamma control block.

According to the present invention, there is provided a method of driving a plasma display panel, including the steps of: preparing a 2.2 gamma table, and one or more modified gamma tables having a gamma value different from that of the 2.2 gamma table, performing an inverse gamma correction process on input data inputted from the outside by using the 2.2 gamma table and the one or more modified gamma tables, and outputting any one of the data on which the inverse gamma correction operation is performed using the 2.2 gamma table and the one or more modified gamma tables.

According to the present invention as described above, data are subjected to inverse gamma correction in two or more inverse gamma correction units, and the inverse gamma corrected data are alternately outputted corresponding to a pixel clock, a vertical sync signal and a horizontal sync signal. Thus, the capability to represent the gray scale can be improved. If the capability to represent the gray scale is improved, error diffusion patterns and pseudo noise can be reduced and the picture quality can be improved.

BRIEF DESCRIPTION OF THE DRAWINGS

The invention will be described in detail with reference to the following drawings in which like numerals refer to like elements.

FIG. 5 is an inverse gamma table stored in the inverse gamma control units shown in FIG. 4 according to a first embodiment;

FIG. 6 is an inverse gamma table stored in the inverse gamma control units shown in FIG. 4 according to a second embodiment;

FIG. 7 is an inverse gamma table stored in the inverse gamma control units shown in FIG. 4 according to a third embodiment.

DETAILED DESCRIPTION OF PREFERRED EMBODIMENTS

Figure 1:
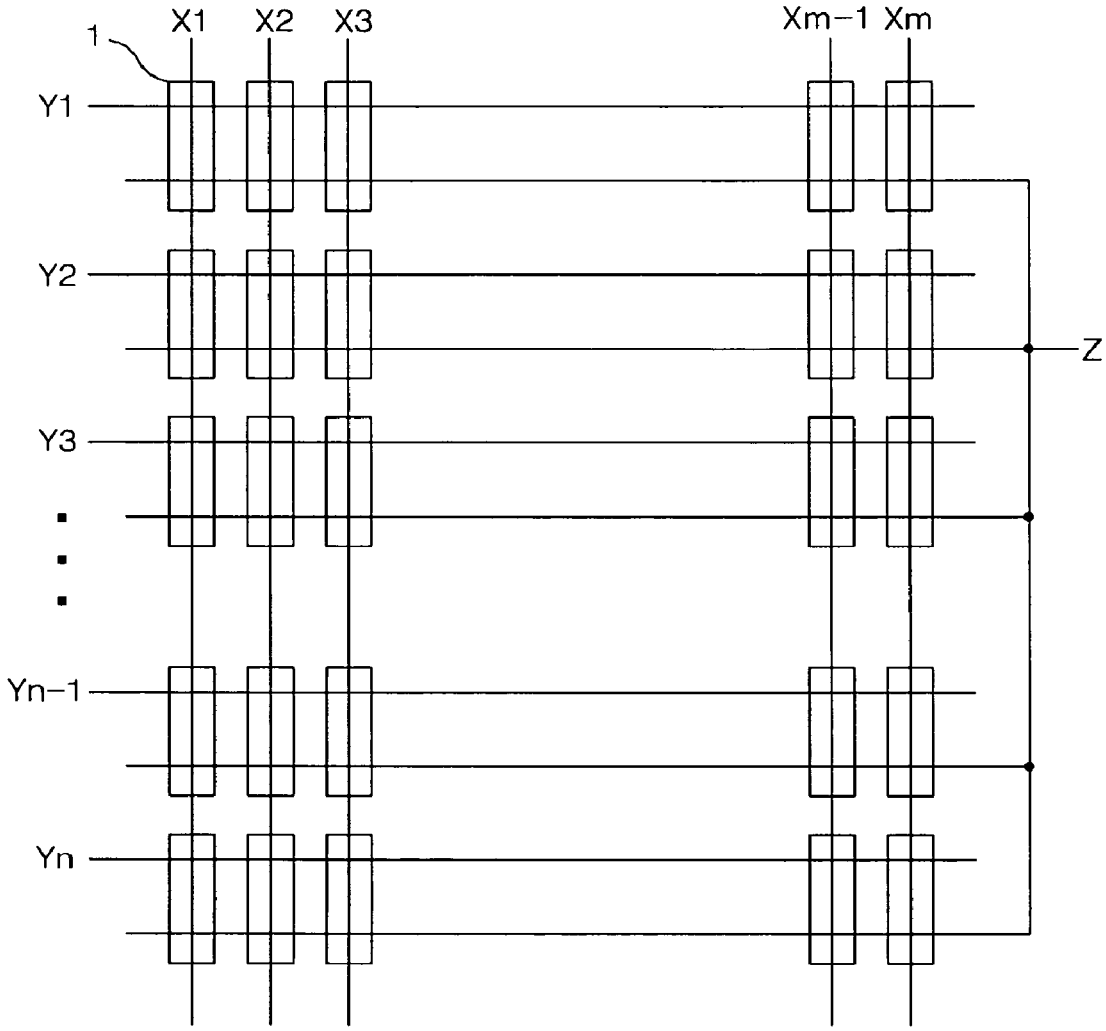
Fig. 1 Related Art
FIG. 1 is a schematic plan view showing a conventional three-electrode AC surface discharge type PDP.
Figure 2:
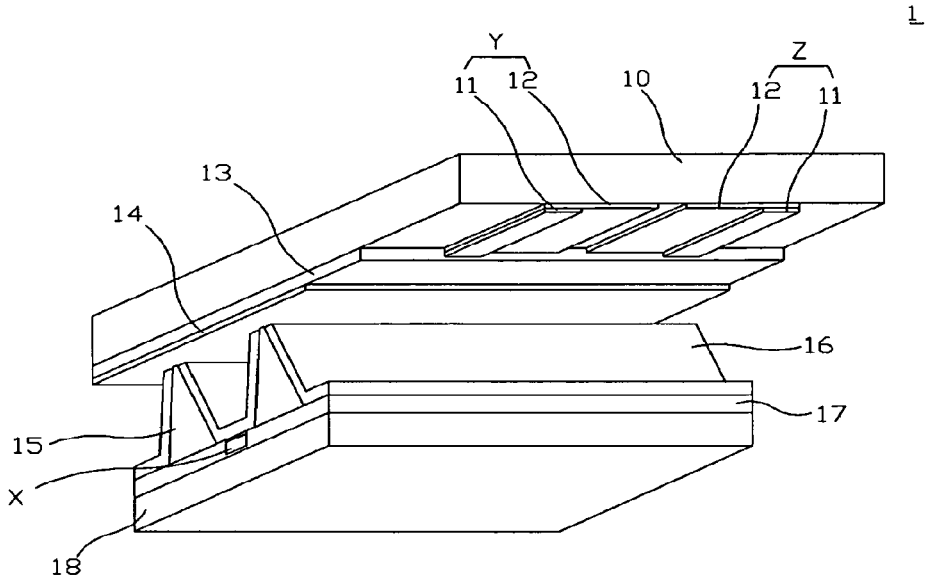
Fig. 2 Related Art
FIG. 2 is a detailed perspective view illustrating the construction of the cell shown in FIG. 1.
Figure 3:
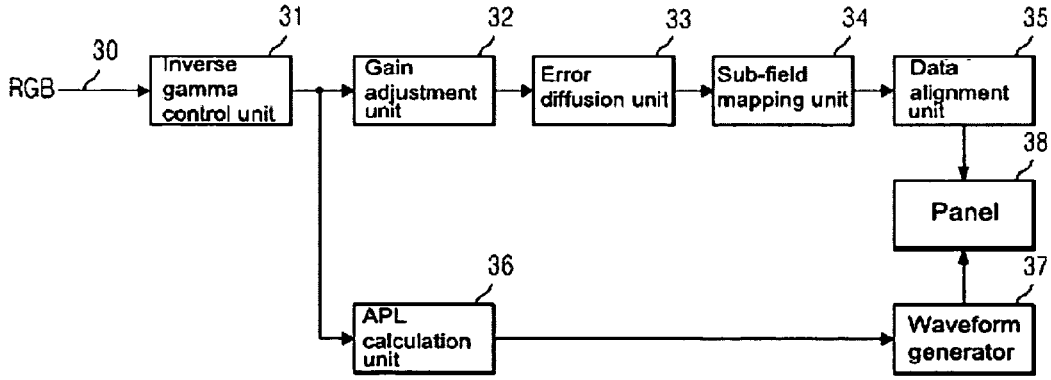
Fig. 3 Related Art
FIG. 3 is a block diagram showing an apparatus for driving a PDP in the prior art.

Preferred embodiments of the present invention will be described in a more detailed manner with reference to the drawings.

According to the present invention, there is provided an apparatus for driving a plasma display panel, including: an inverse gamma control block for performing an inverse gamma correction process on input data received from the outside by using two or more gamma values, and a select unit for outputting one of two or more output data on which the inverse gamma correction operation is performed, which is outputted from the inverse gamma control block.

The inverse gamma control block comprises two or more inverse gamma control units having at least different gamma table, for performing the inverse gamma correction process on the input data.

One of the inverse gamma control units included in the inverse gamma control block performs the inverse gamma correction process on the input data by using a 2.2 gamma table.

The remaining inverse gamma control units except for the inverse gamma control unit having the 2.2 gamma table perform the inverse gamma correction process on the input data by using a modified gamma table, which is modified from the 2.2 gamma table.

The modified gamma table is generated by adding a constant value to the 2.2 gamma table or subtracting a constant value from the 2.2 gamma table.

The modified gamma table is generated by multiplying the 2.2 gamma table by a constant value to or dividing the 2.2 gamma table by a constant value.

The modified gamma table is generated by shifting an output gray scale value of the 2.2 gamma table.

The modified gamma table is generated by changing values of some regions of the 2.2 gamma table.

The modified gamma table is generated by changing values of the entire region of the 2.2 gamma table.

The select unit outputs one of the two or more output data by using one or more of a pixel clock, a horizontal sync signal and a vertical sync signal.

The select unit alternately outputs the two or more output data every pixel according to the pixel clock.

The select unit alternately outputs the two or more output data every line according to the horizontal sync signal.

The select unit alternately outputs the two or more output data every frame according to the vertical sync signal.

According to the present invention, there is provided a method of driving a plasma display panel, including the steps of: preparing a 2.2 gamma table, and one or more modified gamma tables having a gamma value different from that of the 2.2 gamma table, performing an inverse gamma correction process on input data inputted from the outside by using the 2.2 gamma table and the one or more modified gamma tables, and outputting any one of the data on which the inverse gamma correction operation is performed using the 2.2 gamma table and the one or more modified gamma tables.

The modified gamma table is generated by adding a constant value to the 2.2 gamma table or subtracting a constant value from the 2.2 gamma table.

The modified gamma table is generated by multiplying the 2.2 gamma table by a constant value to or dividing the 2.2 gamma table by a constant value.

The modified gamma table is generated by shifting an output gray scale value of the 2.2 gamma table.

The modified gamma table is generated by changing values of some regions of the 2.2 gamma table.

The modified gamma table is generated by changing values of the entire region of the 2.2 gamma table.

The step of outputting any one of the inverse gamma corrected output data includes outputting one of the output data by using one or more of a pixel clock, a horizontal sync signal and a vertical sync signal which are inputted from the outside.

The outputting any one of the inverse gamma corrected output data includes alternately outputting the output data every pixel according to the pixel clock.

The outputting any one of the inverse gamma corrected output data includes alternately outputting the output data every line according to the horizontal sync signal.

The outputting any one of the inverse gamma corrected output data includes alternately outputting the two or more output data every frame according to the vertical sync signal.

Figure 4:
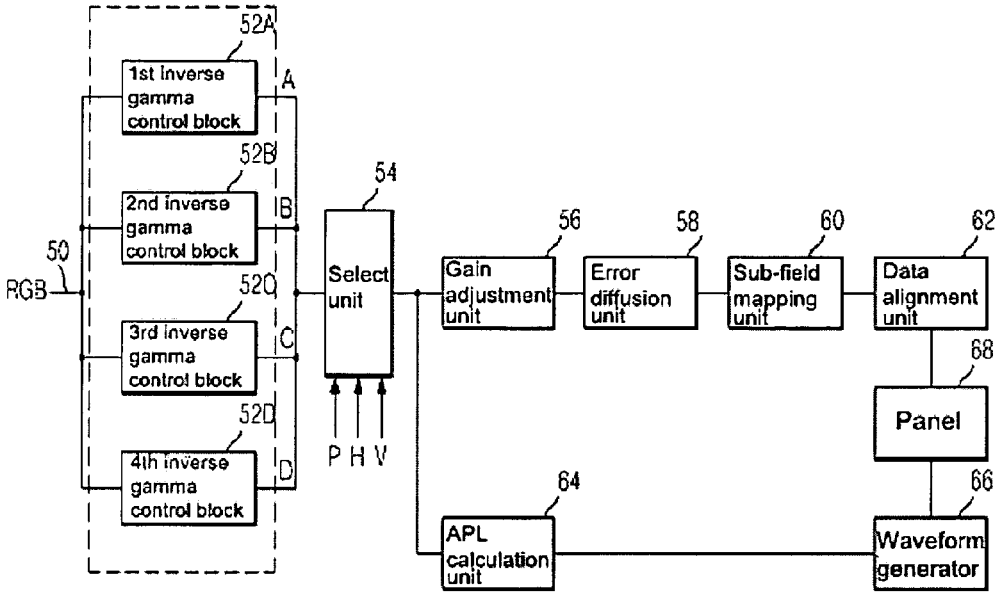
FIG. 4 is a block diagram showing an apparatus for driving a PDP according to an embodiment of the present invention.

FIG. 4 is a block diagram showing an apparatus for driving a PDP according to an embodiment of the present invention.

Referring to FIG. 4, the apparatus for driving the PDP according to this embodiment includes an inverse gamma control block 52; a select unit 54; a gain adjustment unit 56, an error diffusion unit 58, a sub-field mapping unit 60 and a data alignment unit 62 all of which are connected between the select unit 54 and a panel 68; and an APL calculation unit 64 and a waveform generator 66 both of which are connected between the select unit 54 and the panel 68.

The inverse gamma control block 52 performs an inverse gamma correction process on video data RGB received through the input line 50. The select unit 54 selects any one of a plurality of output values received from the inverse gamma control block 52. The construction and operation of the inverse gamma control block 52 and the select unit 54 will be described later on.

The gain adjustment unit 56 adjusts an effective gain by the R (red), G (green) and B (blue) data on which the inverse gamma correction operation is performed, thus compensating for color temperature.

The error diffusion unit 58 finely controls a gray scale value by diffusing a quantization error of the video data RGB received from the gain adjustment unit 56 to neighboring cells.

The sub-field mapping unit 60 maps the data received from the error diffusion unit 58 to sub-field patterns which are previously stored therein on a per bit basis, and supplies the mapped data to the data alignment unit 62.

The data alignment unit 62 supplies the digital video data received from the sub-field mapping unit 60 to a data driving circuit of a panel 68. The data driving circuit is connected to address electrodes of the panel 68. It latches the data received from the data alignment unit 62 by 1 horizontal line and supplies the latched data to the address electrodes of the panel 68 in a 1 horizontal unit.

The APL calculation unit 64 calculates an APL in one screen unit for the data RGB on which the inverse gamma correction operation is performed, and then outputs information on the number of a sustain pulse corresponding to the calculated APL.

The waveform generator 66 generates a timing control signal in response to the information on the number of the sustain pulse outputted from the APL calculation unit 64, and supplies the timing control signal to a scan driving circuit (not shown) and a sustain driving circuit (not shown). The scan driving circuit and the sustain driving circuit supplies the sustain pulse to scan electrodes and sustain electrodes of the panel 68 during a sustain period in response to the timing control signal outputted from the waveform generator 66.

The inverse gamma control block 52 performs an inverse gamma correction on the video data RGB received from the input line 50 by using a plurality of inverse gamma tables. In other words, the inverse gamma control block 52 performs the inverse gamma correction on the video data RGB received from the input line 50 by using a plurality of gamma values, so that a plurality of output gray scale values are generated corresponding to an input gray scale value of one video data RGB.

To this end, the inverse gamma control block 52 includes two or more inverse gamma control units, for example, four inverse gamma control units 52A, 52B, 52C and 53D, as shown in FIG. 4. The first inverse gamma control unit 52A carries out the inverse gamma correction process on the input data by using a 2.2 gamma value in the same manner as the prior art.

The second inverse gamma control unit 52B performs the inverse gamma correction process on the input data by using a gamma value different from that of the first inverse gamma control unit 52A. The third inverse gamma control unit 52C performs the inverse gamma correction process on the input data by using a gamma value different from those of the first and second inverse gamma control units 52A, 52B. The fourth inverse gamma control unit 52D performs the inverse gamma correction process on the input data by using a gamma value different from those of the first to third inverse gamma control units 52A to 52C.

Therefore, an input gray scale value of one data received from the input line 50 undergoes the inverse gamma correction operation to become four gamma values, and is then outputted as four gray scale values. In this time, the inverse gamma control unit 52A of the plurality of the inverse gamma control units 52A to 52D that are included in the inverse gamma control block 52 has a 2.2 gamma table, and the remaining inverse gamma control units 52B to 52D have a gamma table which is modified from the 2.2 gamma table.

The gamma tables of the second to fourth inverse gamma control units 52B to 52D can be modified into various shapes from the 2.2 gamma table. For example, as shown in FIG. 5, the second to fourth inverse gamma control units 52B to 52D can generate the gamma tables by adding a constant value to the 2.2 gamma table or subtracting a constant value from the 2.2 gamma table. The gamma table of the second inverse gamma control unit 52B can be generated by adding a value of 0.1 to the 2.2 gamma table. The gamma table of the third inverse gamma control unit 52C can be generated by adding a value of 0.01 to the 2.2 gamma table. Also, the gamma table of the fourth inverse gamma control unit 52D can be generated by adding a value of 0.2 to the 2.2 gamma table. In this time, if the gamma table is generated by adding a constant value to the 2.2 gamma table, the capability of represent a low gray scale is improved, as shown in FIG. 5. In other words, in the 2.2 gamma table, the gray scale of '0' to '5' received from the outside outputs a gray scale value of '0'. If the gamma table is generated by adding a constant value to the 2.2 gamma table, however, a given gray scale value is outputted even in a gray scale. It is thus possible to improve the capability for representing the low gray scale.

Furthermore, the gamma table of each of the second to fourth inverse gamma control units 52B to 52D can be generated by shifting the 2.2 gamma table up and down, as shown in FIG. 6. For example, the gamma table of the second inverse gamma control unit 52B is generated by upwardly shifting the 2.2 gamma table every 3 gray levels. The gamma table of the third inverse gamma control unit 52C is generated by upwardly shifting the 2.2 gamma table every 6 gray levels. Also, the gamma table of the fourth inverse gamma control unit 52D is generated by upwardly shifting the 2.2 gamma table every 4 gray levels. In this time, if the gamma table is generated by shifting the 2.2 gamma table, the capability to represent the gray scale can be improved, as shown in FIG. 6.

Furthermore, the gamma table of each of the second to fourth inverse gamma control units 52B to 52D can be generated by modifying some gray scales of the 2.2 gamma table, as shown in FIG. 7. For example, the gamma table of each of the second to fourth inverse gamma control units 52B to 52D can be generated by modifying a low gray scale region (for example, below 16 gray scales) of the 2.2 gamma table.

Practically, according to the preset invention, the gamma tables of the second to fourth inverse gamma control units 52B to 52D can be generated by a variety of methods. For example, the gamma tables of the second to fourth inverse gamma control units 52B to 52D can be generated by multiplying the 2.2 gamma table by a constant value to or dividing the 2.2 gamma table by a constant value. Moreover, the gamma tables of the second to fourth inverse gamma control units 52B to 52D can be generated by mixing the methods shown in FIG. 5 and FIG. 7. In other words, an inverse gamma table of the second inverse gamma control unit 52B can be generated by adding a constant value to the 2.2 gamma table or subtracting a constant value from the 2.2 gamma table. An inverse gamma table of the third inverse gamma control unit 52C can be generated by changing some regions of the 2.2 gamma table. Also, an inverse gamma table of the fourth inverse gamma control unit 52D can be generated by shifting the 2.2 gamma table. Practically, according to the present invention, the gamma tables of the second to fourth inverse gamma control units 52B to 52D are determined to have a value in which an optimum image is displayed experimentally.

The select unit 54 outputs any one of the gray scale values which are received from the first to fourth inverse gamma control units 52A to 52D. To this end, the select unit 54 receives a pixel clock P, a horizontal sync signal H and a vertical sync signal V from the outside. The select unit 54 that received the pixel clock P, the horizontal sync signal H and the vertical sync signal V selects any one of the gray scale values received from the first to fourth inverse gamma control units 52A to 52D by using one of the pixel clock P, the horizontal sync signal H and the vertical sync signal V.

Figure 8A:
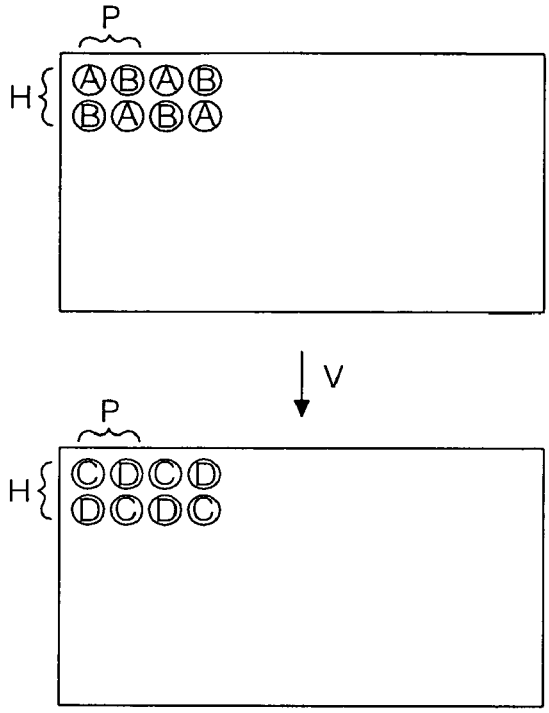
FIGS. 8*a* and 8*b* are view showing output data outputted under the control of the select unit shown in FIG. 4.

For example, the select unit 54 alternately displays first output gray scales A of the first inverse gamma control unit 52A and second output gray scales B of the second inverse gamma control unit 52B corresponding to the pixel clock P and the horizontal sync signal H in an $i^{th}$ (i is natural number) frame, as shown in FIG. 8*a*. In this case, two of the four output gray scale values are alternately displayed corresponding to the pixel clock P and the horizontal sync signal H. The select unit 54 then alternately displays third output gray scales C of the third inverse gamma control unit 52C and fourth output gray scales D of the fourth inverse gamma control unit 52D corresponding to the pixel clock P and the horizontal sync signal H, in an $(i+1)^{th}$ frame separated by the vertical sync signal V.

As such, if the output values of the first to fourth inverse gamma control units 52A to 52D are controlled using the pixel clock P, the horizontal sync signal H and the vertical sync signal V, an image of corrected data can be displayed with a different gamma value every frame, pixel and line. Accordingly, the gray scale can be expanded on average. In other words, in the prior art, only images corresponding to data on which an inverse gamma correction operation is performed are displayed using the 2.2 gamma table. Accordingly, the gray scales that can be represented are limited. In the present invention, however, an image is displayed using data on which an inverse gamma correction operation is performed by using two or more different gamma tables. Therefore, a variety of gray scales can be displayed on average.

Furthermore, according to the present invention, error diffusion is performed by using output gray scale values (i.e., output data) outputted from the select unit 54. An error diffusion pattern is prevented from occurring. That is, the error diffusion pattern is generated since the error diffusion coefficients are repeated constantly. In the present invention, however, data on which an inverse gamma correction operation is performed by using different gamma tables is outputted from the select unit 54 every pixel, line and frame. There occurs a difference in a gray scale value every pixel. Accordingly, although error diffusion is performed by using error diffusion coefficients having a constant weight, the error diffusion pattern is not generated.

Figure 8B:
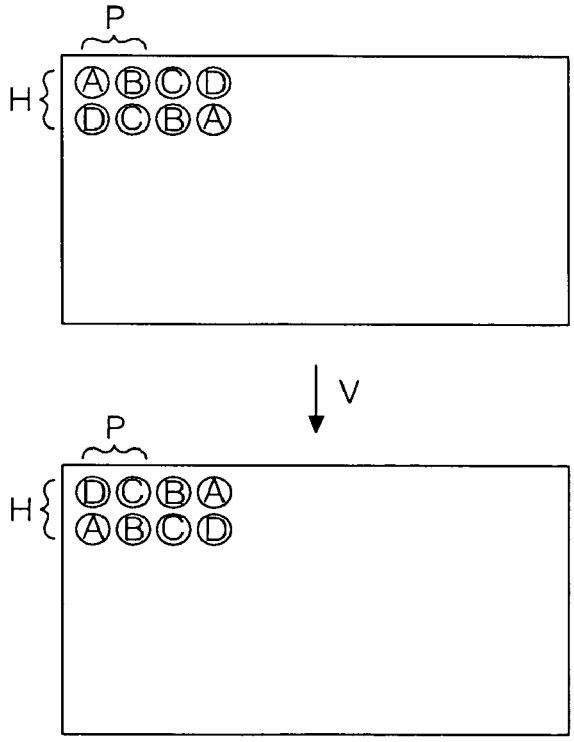

Meanwhile, according to the present invention, the outputs of the select unit 54 can be set variously corresponding to one or more of the pixel clock P, the horizontal sync signal H and the vertical sync signal V. For example, the select unit 54 alternately outputs the first to fourth output gray scales A to D corresponding to the pixel clock P, and also alternately outputs the first to fourth output gray scales A to D every line corresponding to the horizontal sync signal H, as shown in FIG. 8*b*. Furthermore, the select unit 54 alternately outputs the first to fourth output gray scales A to D every frame corresponding to the vertical sync signal V. Practically, in the present invention, the output in the select unit 54 is experimentally decided to have a value in which an optimum image can be displayed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for driving a plasma display panel, comprising:

an inverse gamma control block for performing an inverse gamma correction process on input data received from a data signal; and a select unit for selecting data outputted from the inverse gamma control block, wherein the data outputted from the inverse gamma control block is selected such that an image is displayed on the plasma display panel with a different gray scale value for every pixel.

2. The method as claimed in claim 1, wherein the inverse gamma correction process uses at least three inverse gamma tables, wherein each table uses a different gamma value.

3. An apparatus for driving a plasma display panel, comprising:

an inverse gamma control block for performing an inverse gamma correction process on input data received from a data signal by using two or more gamma values; and a select unit for selecting one of two or more output data on which the inverse gamma correction operation is performed, which is outputted from the inverse gamma control block, wherein the select unit outputs one of the two or more output data by using one or more of a pixel clock, a horizontal sync signal and a vertical sync signal.

4. The apparatus as claimed in claim 3, wherein the inverse gamma control block comprises two or more inverse gamma control units having at least different gamma table, for performing the inverse gamma correction process on the input data.

5. The apparatus as claimed in claim 4, wherein one of the inverse gamma control units included in the inverse gamma control block performs the inverse gamma correction process on the input data by using a 2.2 gamma table.

6. The apparatus as claimed in claim 5, wherein the remaining inverse gamma control units except for the inverse gamma control unit having the 2.2 gamma table perform the inverse gamma correction process on the input data by using a modified gamma table which is modified from the 2.2 gamma table.

7. The apparatus as claimed in claim 6, wherein the modified gamma table is generated by adding a constant value to the 2.2 gamma table or subtracting a constant value from the 2.2 gamma table.

8. The apparatus as claimed in claim 7, wherein the modified gamma table is generated by changing values of some regions of the 2.2 gamma table.

9. The apparatus as claimed in claim 7, wherein the modified gamma table is generated by changing values of the entire region of the 2.2 gamma table.

10. The apparatus as claimed in claim 6, wherein the modified gamma table is generated by multiplying the 2.2 gamma table by a constant value to or dividing the 2.2 gamma table by a constant value.

11. The apparatus as claimed in claim 10, wherein the modified gamma table is generated by changing values of some regions of the 2.2 gamma table.

12. The apparatus as claimed in claim 10, wherein the modified gamma table is generated by changing values of the entire region of the 2.2 gamma table.

13. The apparatus as claimed in claim 6, wherein the modified gamma table is generated by shifting an output gray scale value of the 2.2 gamma table.

14. The apparatus as claimed in claim 13, wherein the modified gamma table is generated by changing values of some regions of the 2.2 gamma table.

15. The apparatus as claimed in claim 13, wherein the modified gamma table is generated by changing values of the entire region of the 2.2 gamma table.

16. The apparatus as claimed in claim 5, wherein the modified gamma table is generated by changing values of some regions of the 2.2 gamma table.

17. The apparatus as claimed in claim 5, wherein the modified gamma table is generated by changing values of the entire region of the 2.2 gamma table.

18. The apparatus as claimed in claim 2, wherein the select unit alternately outputs the two or more output data every pixel according to the pixel clock.

19. The apparatus as claimed in claim 2, wherein the select unit alternately outputs the two or more output data every line according to the horizontal sync signal.

20. The apparatus as claimed in claim 2, wherein the select unit alternately outputs the two or more output data every frame according to the vertical sync signal.

21. A method of driving a plasma display panel, comprising the steps of:

(a) preparing a 2.2 gamma table, and one or more modified gamma tables having a gamma value different from that of the 2.2 gamma table;

(b) performing an inverse gamma correction process on input data inputted from the outside by using the 2.2 gamma table and the one or more modified gamma tables; and (c) outputting any one of the data on which the inverse gamma correction operation is performed using the 2.2 gamma table and the one or more modified gamma tables.

22. The method as claimed in claim 21, wherein the modified gamma table is generated by adding a constant value to the 2.2 gamma table or subtracting a constant value from the 2.2 gamma table.

23. The method as claimed in claim 22, wherein the modified gamma table is generated by changing values of some regions of the 2.2 gamma table.

24. The method as claimed in claim 22, wherein the modified gamma table is generated by changing values of the entire region of the 2.2 gamma table.

25. The method as claimed in claim 21, wherein the modified gamma table is generated by multiplying the 2.2 gamma table by a constant value to or dividing the 2.2 gamma table by a constant value.

26. The method as claimed in claim 25, wherein the modified gamma table is generated by changing values of some regions of the 2.2 gamma table.

27. The method as claimed in claim 25, wherein the modified gamma table is generated by changing values of the entire region of the 2.2 gamma table.

28. The method as claimed in claim 21, wherein the modified gamma table is generated by shifting an output gray scale value of the 2.2 gamma table.

29. The method as claimed in claim 28, wherein the modified gamma table is generated by changing values of some regions of the 2.2 gamma table.

30. The method as claimed in claim 28, wherein the modified gamma table is generated by changing values of the entire region of the 2.2 gamma table.

31. The method as claimed in claim 21, wherein the step of outputting any one of the inverse gamma corrected output data includes outputting one of the output data by using one or more of a pixel clock, a horizontal sync signal and a vertical sync signal which are inputted from the outside.

32. The method as claimed in claim 31, wherein the outputting any one of the inverse gamma corrected output data includes alternately outputting the output data every pixel according to the pixel clock.

33. The method as claimed in claim 31, wherein the outputting any one of the inverse gamma corrected output data includes alternately outputting the output data every line according to the horizontal sync signal.

34. The method as claimed in claim 31, wherein the outputting any one of the inverse gamma corrected output data includes alternately outputting the two or more output data every frame according to the vertical sync signal.

* * * * *